US005348035A

United States Patent [19]

Porter

[11] Patent Number: 5,348,035

[45] Date of Patent: Sep. 20, 1994

[54] HARNESS ASSEMBLY FOR A CRUTCH USER

[75] Inventor: Jerry Porter, Charlottesville, Va.

[73] Assignee: John S. Fisher, Raleigh, N.C. ; a part interest

[21] Appl. No.: 48,278

[22] Filed: Apr. 14, 1993

[51] Int. Cl.[5] ..... A61H 3/02

[52] U.S. Cl. ..... 135/66; 135/68; 182/3

[58] Field of Search ..... 135/67, 68, 65, 66; 244/151 R; 119/770, 857, DIG. 1; 482/66, 69; 182/3, 6; 280/801

[56] References Cited

U.S. PATENT DOCUMENTS

| | | | |
|---|---|---|---|
| 1,769,167 | 7/1930 | Scheihing . | |
| 2,351,145 | 6/1944 | Pearson | 272/70.1 |
| 2,719,568 | 10/1955 | Webb | 482/69 X |
| 2,887,286 | 5/1959 | Moran | 244/15 R X |
| 3,424,134 | 1/1969 | Rosenblum | 244/151 R X |
| 3,778,052 | 12/1973 | Andow et al. | 272/70.4 |
| 4,245,659 | 1/1981 | Shofner | 135/68 |
| 4,410,175 | 10/1983 | Shamp | 244/151 R X |
| 4,553,633 | 11/1985 | Armstrong et al. | 119/857 X |
| 4,720,064 | 1/1988 | Herndon | 244/151 R X |
| 4,793,370 | 12/1988 | Perez et al. | 135/69 |
| 4,924,894 | 5/1990 | Martinez | 135/65 |
| 4,941,497 | 7/1990 | Prather et al. | 135/67 |
| 5,080,191 | 1/1992 | Sanchez | 244/151 R X |
| 5,145,027 | 9/1992 | Petzl et al. | 244/151 R X |
| 5,203,829 | 4/1993 | Fisk et al. | 119/857 |

FOREIGN PATENT DOCUMENTS

| | | | |
|---|---|---|---|
| 1713582 | 2/1992 | U.S.S.R. | 135/68 |
| 1717135 | 3/1992 | U.S.S.R. | 135/68 |

OTHER PUBLICATIONS

"A New Saddle Crutch" by Dr. James R. Taylor in *The Medical Review* (1883).

*Primary Examiner*—Lanna Mai

*Attorney, Agent, or Firm*—Richard E. Jenkins

[57] ABSTRACT

A crutch harness assembly including a belt element adapted to be secured around a waist of the user, two loop-like strap elements connected to the belt element and each adapted to surround and engage a respective upper leg portion, and a strap means connected to each of the loop-like strap elements and adapted for engaging a corresponding crutch adjacent the upper end of said crutch.

12 Claims, 4 Drawing Sheets

HARNESS ASSEMBLY FOR A CRUTCH USER

TECHNICAL FIELD

The present invention relates generally to a support system for a crutch user, and more particular to a harness system for a crutch user which serves to transfer a significant portion of body weight from the hands, arms, underarm areas and shoulders to the harness and crutches so as to reduce the fatigue, exertion, and damage associated with use of crutches.

RELATED ART

The field of the prior art includes several prior attempts to provide a support system for crutches. For example, the publication titled "A New Saddle Crutch" by Dr. James R. Taylor in *The Medical Review* (1883) discloses a "saddle" which is suspended between two crutches and which purportedly allows the user to sit on the seat and propel himself forward without any exertion of his arms. Applicant believes that this device would be extremely uncomfortable and impractical in use.

Also, U.S. Pat. No. 4,245,659 to Shofner discloses a crutch assembly wherein two crutches are secured together by a cross member, and the entire crutch assembly is provided with chest straps in order to be secured to a user. The patent discloses that the crutch assembly is intended to better distribute the weight of the user in order to relieve the pressure produced by conventional crutches on the arms and wrists, hands and elbows. Applicant believes that this device is also quite impractical in actual use since the chest straps securing the crutch assembly to the user would, in practice, be too tight to allow for ease of breathing by the user.

Thus, the search for a practical and comfortable crutch support system has continued due to the well-known discomfort and taxing exertion of attempting to walk on crutches for any appreciable time. An easy to use and comfortable crutch support system has not yet been developed until applicant's invention as described hereinbelow.

DISCLOSURE OF THE INVENTION

In accordance with the present invention, applicant provides a harness assembly for use with crutches designed specifically for minimizing the discomfort and exertion associated with the use of crutches. The crutch harness assembly comprises a belt element adapted to be secured around the waist of the harness user and includes two or more loop-like strap elements connected thereto. The loop-like strap elements are each adapted to surround and engage the upper leg portion of a corresponding leg of the harness user. Strap means are connected to each of the loop-like strap elements and adapted for engaging a corresponding crutch adjacent the upper end thereof so as to transmit at least a portion of the body weight to the loop-like strap elements and to thereby reduce the force applied by a pair of crutches to the hands and underarm areas of the harness user.

It is therefore the object of the present invention to provide a crutch harness assembly which reduces the force applied to a pair of crutches by the hands and underarm areas of the harness assembly user by transmitting the force to the novel harness assembly connected to the crutches.

It is another object of the present invention to reduce the effort required to walk on a pair of crutches and thereby facilitate extended use of the crutches without undue discomfort to the user.

It is yet another object of the present invention to provide a crutch harness assembly which serves to transmit a major portion of the body weight to the crutches and the padded loop-like strap elements of the harness extending around the upper legs under the gluteal folds.

Some of the objects of the invention having been stated, other objects will become evident as the description proceeds, when taken in connection with the accompanying drawings described hereinbelow.

BEST MODE FOR CARRYING OUT THE INVENTION

Figure 1:
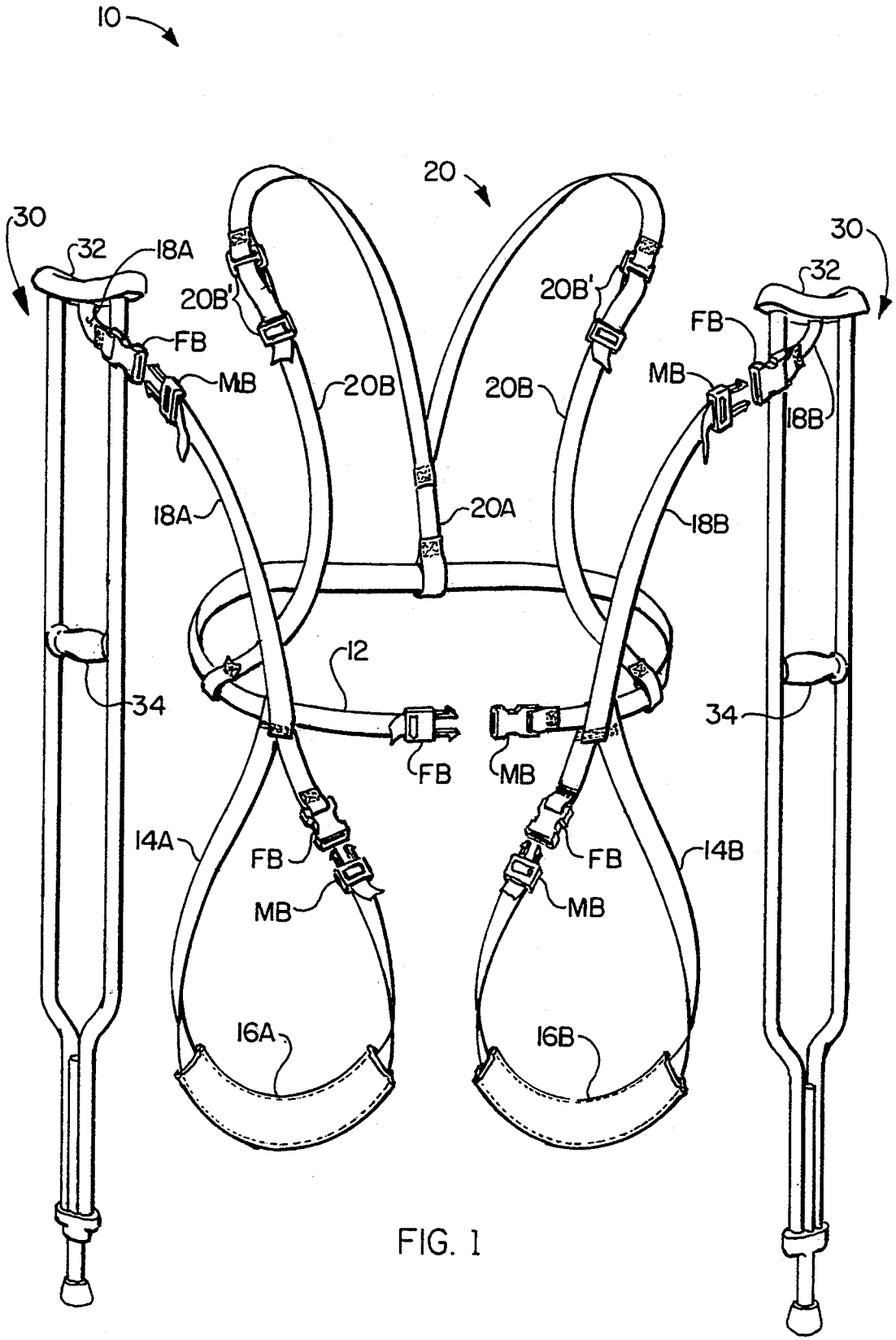
FIG. 1 is a perspective view of a crutch harness assembly of the invention.

With reference now to the drawings, FIGS. 1–4 disclose a crutch harness assembly, generally designated 10, comprising a belt 12 including a female bracket element FB and male element bracket MB which allow for adjustment of the length of belt 12 as well as serving to lock/unlock the belt. Two leg straps 14A and 14B, respectively, are secured to belt 12 by stitching or other suitable means and each strap 14A, 14B includes a bracket consisting of a female bracket element FB and male bracket element MB for locking/unlocking the strap. Leg straps 14A, 14B also each include a pad 16A and 16B, respectively, so as to facilitate engagement of the upper leg portion by each strap and to position the associated pads, 16A and 16B, under the gluteal fold of each corresponding upper leg portion.

Support straps 18A and 18B, respectively, are attached to corresponding leg straps 14A and 14B by stitching or other suitable means so as to be securely connected thereto. Support straps 18A and 18B also each include a bracket consisting of female bracket element FB and male bracket element MB for locking-/unlocking of each respective support strap. The upper ends of support straps 18A and 18B are each connected to the upper end 32 of a corresponding crutch 30 (see FIG. 1). As a matter of design choice, the upper end of each support strap 18A and 18B, respectively, may be either removably attached by means of a VELCRO loop or the like (not shown) to upper end 32 of crutch 30 or, in the alternative, fixedly attached to the same by any suitable means. In this fashion, applicant contemplates that crutch harness assembly 10 could be provided as a retrofit to existing crutches 30 if support straps 18A and 18B are adapted for removable attachment or, in the alternative, crutch harness assembly 10 could be constructed as an integral part of a pair of crutches 10 if the upper ends of support straps 18A and 18B are permanently secured to the upper ends 32 of crutches 30.

As an optional feature of applicant's novel crutch harness assembly 10, applicant contemplates that a pair of suspenders 20 may be provided to aid belt 12 in maintaining leg straps 14A and 14B in place if the user of the crutch harness assembly has a body shape which does not serve to maintain belt 12 in place around the waist of the user. The suspenders 20 may be of any suitable construction but, as shown in the drawings, a preferred construction provides a singular back strap 20A which is movably secured at one end to belt 12 and which has a pair of diverging straps 20B which extend over the shoulders and across the chest of the user and terminate in ends which are movably secured to belt 12 at the front or side thereof. Suspenders 20 are each provided with conventional length adjustment means 20B' as best shown in FIG. 1 of the drawings.

In use, an individual (see phantom line user shown in FIGS. 2–4) secures belt 12 around his waist and a respective support strap 14A, 14B around the upper portion of each leg so that pads 16A, 16B are each positioned under the gluteal fold of the upper portion of each leg. If suspenders 20 are utilized, the suspenders are positioned in place over the upper body of the user and adjusted by means of length adjustment means 20B' so as to snugly support belt 12 around the waist of the user. However, applicant wishes to emphasize (as noted hereinabove) that crutch harness assembly 10 may be fabricated either with or without suspenders 20 which are believed to be necessary only in circumstances wherein belt 12 cannot be made to snugly engage the waist of the user.

Once the user has locked belt 12 and leg straps 14A, 14B into place by means of inserting male bracket element MB into female bracket element FB of the brackets provided with belt 12 and leg straps 14A, 14B, the user next attaches support straps 18A and 18B to a respective crutch by means of inserting male bracket element MB into female bracket element FB of the bracket provided with each support strap. In this fashion, support straps 18A and 18B are each secured to a respective crutch 30 and the user is now ready to walk on crutches 30 once any final adjustments to the length of belt 12, leg straps 14A and 14B and/or support straps 18A and 18B are made by conventional length adjustment means associated with the female bracket element FB of each strap.

Figure 2:
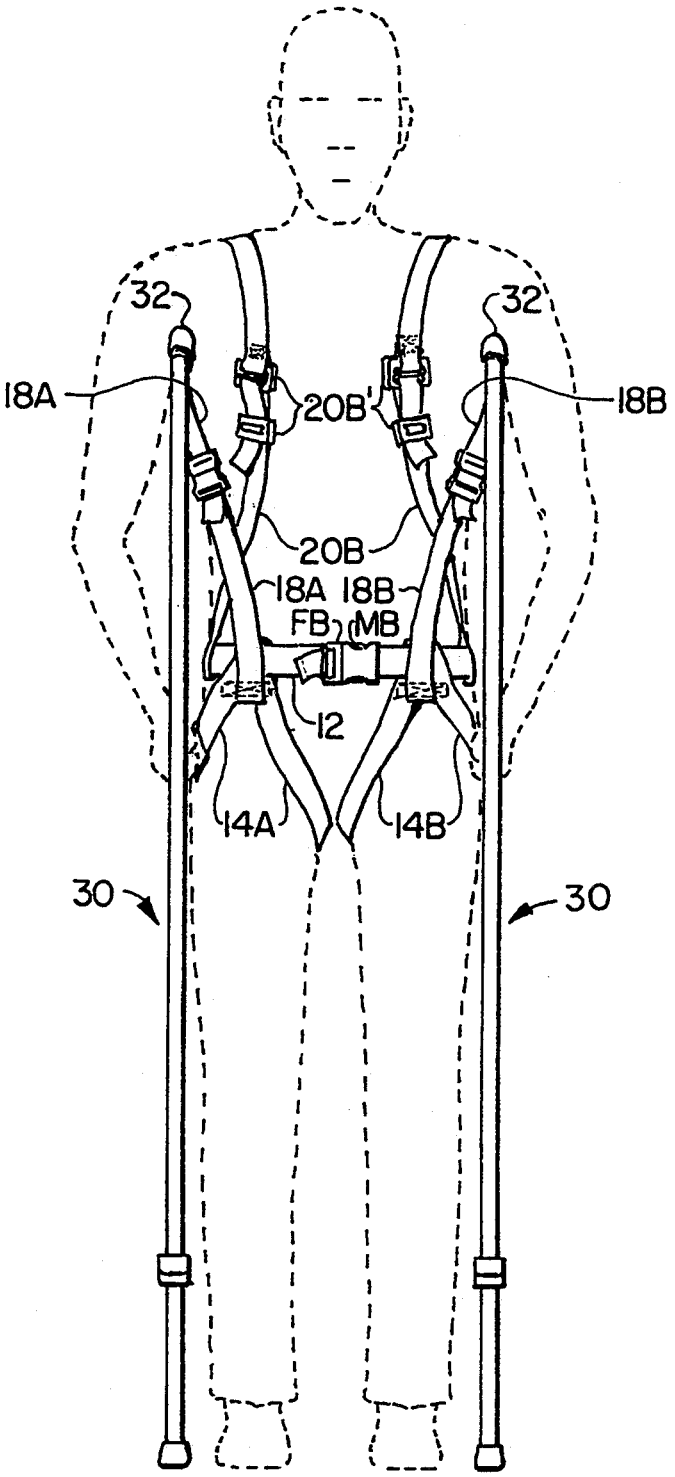
FIG. 2 is a front elevation view of the crutch harness assembly secured to a user (shown in phantom lines)
Figure 3:
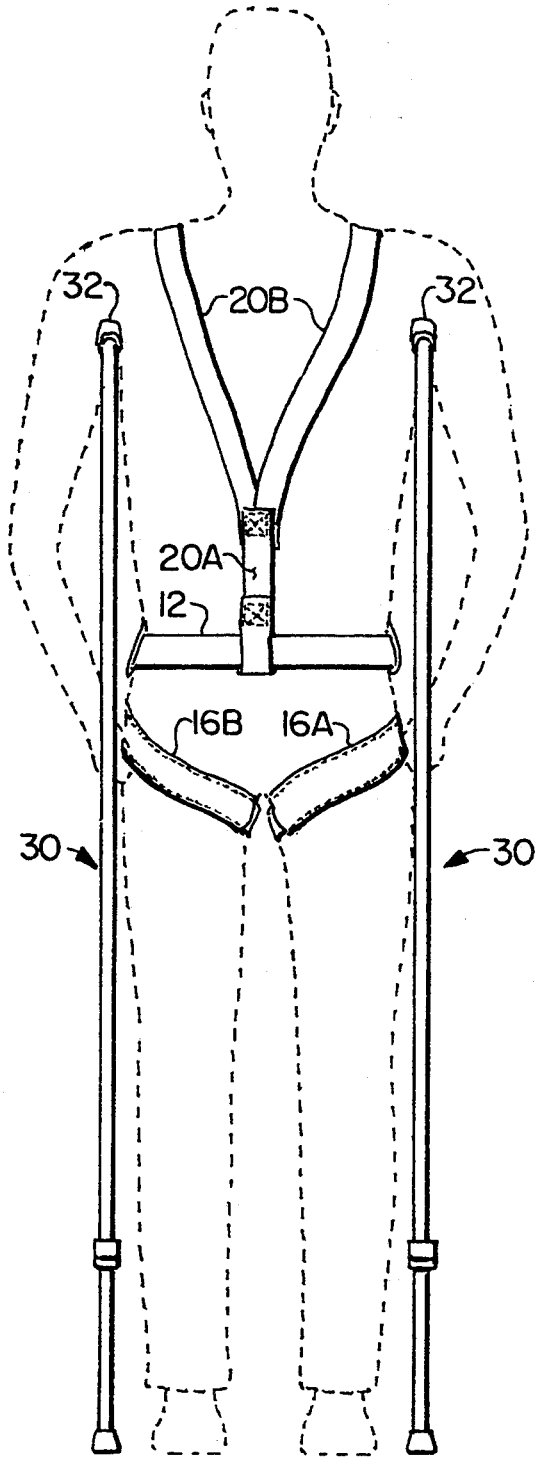
FIG. 3 is a rear elevation view of the crutch harness assembly secured to a user (shown in phantom lines)
Figure 4:
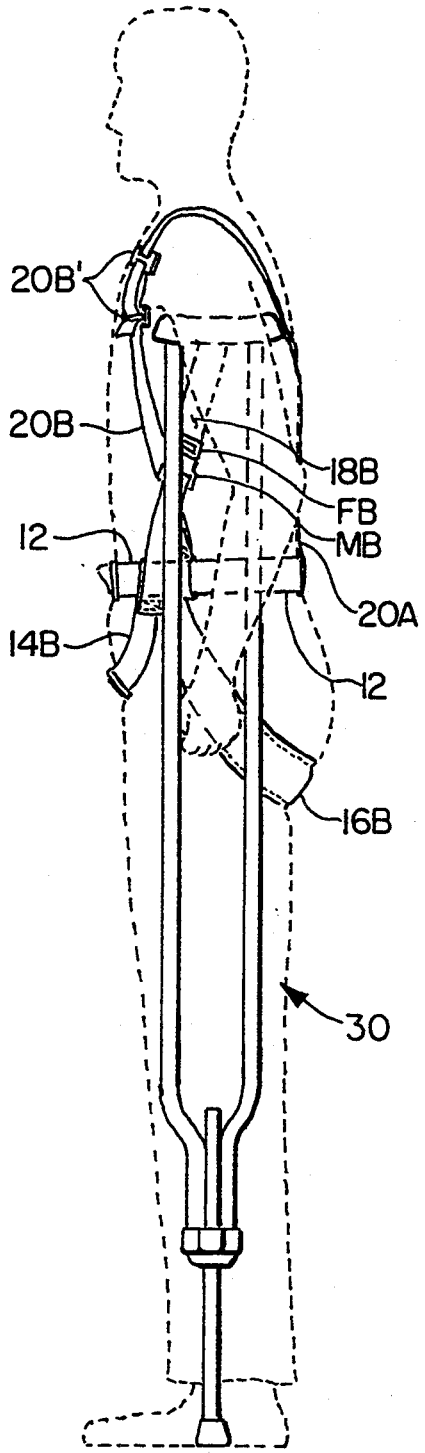
FIG. 4 is a side elevation view of the crutch harness assembly secured to a user (shown in phantom lines).

As can be particularly appreciated with reference to FIGS. 2–4 of the drawings, crutch harness assembly acts to distribute the weight of the user around the upper legs and under the gluteal folds as opposed to being carried by the hands (which normally engage handle 34 of crutch 30) and the underarm area of each arm. Since users are accustomed to sitting on their upper legs and buttocks, distributing weight to the upper legs and under the gluteal folds thereof does not in any fashion hinder breathing or otherwise discomfort the user of crutch harness assembly 10.

To more specifically describe the weight distribution function of applicant's novel crutch harness assembly, applicant wishes to note that crutches are normally prescribed so as to prevent part or all of the body weight normally borne by one of the legs in walking from being applied thereto. Thus, a user of crutches utilizes the normal leg in the usual manner so as to bear the body's weight during its half of the walking cycle. However, during the other half of the walking cycle, the weight which would normally be borne by the injured leg is instead borne by the hands attached to handles 34 of crutches 30 and the underarm areas of the user. Thus, the body's weight is alternately borne by the good leg and then by the hands and underarm areas so that each step entails a "push-up" type motion. As is well known to those familiar with the use of crutches, only a person in excellent physical condition can act to perform a series of "push-ups" for a prolonged period of time, and hence the use of a pair of crutches results in muscular discomfort and limited use by the ordinary individual. Moreover, there is danger to users whose cardiac or pulmonary function is impaired since they may not be able be withstand the extraordinary exertion required by constant use of crutches 30.

In contrast, applicant's novel crutch harness assembly 10 is constructed so as to transfer a large portion of the user's body weight to the padded support straps 18A and 18B positioned around the upper legs and under the gluteal folds thereof. Applicant has discovered that an experienced user of the instant invention may find that their hands are required only to control crutches 30 and not to lift the body weight. Summarily, applicant's novel harness assembly serves to transfer a major portion of the body weight from the hands and underarm areas through support straps 18A and 18B to leg straps 14A and 14B so that a major portion of the body weight is borne by the upper legs of the user which are better adapted to accommodate the forces applied by the weight than the hands and underarm areas of the user of the pair of crutches.

It will be understood that various details of the invention may be changed without departing from the scope of the invention. Furthermore, the foregoing description is for the purpose of illustration only, and not for the purpose of limitation—the invention being defined by the claims.

What is claimed is:

1. A crutch harness system adapted to engage the waist, and upper leg portion and gluteal fold of each leg of a harness user for supporting at least a portion of the harness user's body weight to reduce forces applied to the hands and underarm areas, and comprising:

a pair of crutches wherein each crutch comprises an upper end and a lower end;

a belt element adapted to be secured around the waist of the harness user;

two or more loop-like strap elements cooperatively connected to said belt element and each being adapted to surround and engage the upper leg portion of a corresponding leg of the harness user so that the upper leg portion of each leg of the harness user has one or more loop-like strap elements positioned therearound; and strap means cooperatively connected to each of said loop-like strap elements and each of said strap means engaging a corresponding one of said pair of crutches adjacent the upper end of said crutch and for transmitting at least a portion of the body weight to said loop-like strap elements so as to reduce the force applied to said pair of crutches by the hands and underarm areas of the harness user.

2. A crutch assembly according to claim 1 wherein said belt element includes a buckle.

3. A crutch assembly according to claim 1 wherein each of said loop-like strap elements includes a buckle.

4. A crutch assembly according to claim 1 including a pad on each of said loop-like strap elements positioned so that said pads each nest under the gluteal fold of the upper portion of a corresponding leg of the harness user.

5. A crutch assembly according to claim 1 wherein each of said strap means includes a buckle.

6. A crutch assembly according to claim 1 wherein said crutch harness system includes a pair of suspender straps cooperatively connected to said belt element.

7. A crutch assembly according to claim 6 wherein said suspender straps are each adapted for adjustment to a selected length.

8. A crutch harness system adapted to engage the waist, and upper leg portion and gluteal fold of each leg of a harness user for supporting at least a portion of the harness user's body weight to reduce forces applied to the hands and underarm areas, and comprising:

a pair of crutches wherein each crutch comprises an upper end and a lower end;

a belt element adapted to be secured around the waist of the harness user;

two loop-like strap elements cooperatively connected to said belt element and each being adapted to surround and engage the upper leg portion of a corresponding leg of the harness user so that the upper leg portion of each leg of the harness user has one or more loop-like strap elements positioned therearound said strap elements each including a pad positioned thereon so that said pads each nest under the gluteal fold of a corresponding upper leg portion;

strap means cooperatively connected to each of said loop-like strap elements and each of said strap means engaging a corresponding one of said pair of crutches adjacent the upper end of said crutch and for transmitting at least a portion of the body weight to said loop-like strap elements so as to reduce the force applied to said pair of crutches by the hands and underarm areas of the harness user; and a pair of suspender straps operatively connected to said belt element.

9. A crutch assembly according to claim 8 wherein said belt element includes a buckle.

10. A crutch assembly according to claim 8 wherein each of said loop-like strap elements includes a buckle.

11. A crutch assembly according to claim 8 wherein each of said strap means includes a buckle.

12. A crutch assembly according to claim 8 wherein said suspender straps are each adapted for adjustment to a selected length.

* * * * *